US011898572B2

(12) United States Patent
Li et al.

(10) Patent No.: US 11,898,572 B2
(45) Date of Patent: Feb. 13, 2024

(54) IMPELLER WAKE VORTEX DISSIPATION DEVICE UNDER STALL CONDITION OF MIXED FLOW PUMP

(71) Applicant: JIANGSU UNIVERSITY, Zhenjiang (CN)

(72) Inventors: Wei Li, Zhenjiang (CN); Leilei Ji, Zhenjiang (CN); Ling Zhou, Zhenjiang (CN); Yong Zhu, Zhenjiang (CN); Sizhuo Ma, Zhenjiang (CN); Handong Qi, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 17/781,054

(22) PCT Filed: Jul. 16, 2021

(86) PCT No.: PCT/CN2021/106645

§ 371 (c)(1),
(2) Date: Oct. 27, 2022

(87) PCT Pub. No.: WO2022/222288

PCT Pub. Date: Oct. 27, 2022

(65) Prior Publication Data

US 2024/0018969 A1 Jan. 18, 2024

(30) Foreign Application Priority Data

Apr. 21, 2021 (CN) ..... 202110428441.1

(51) Int. Cl.

| | |
|---|---|
| ***F04D 29/18*** | (2006.01) |
| ***F04D 29/44*** | (2006.01) |
| ***F04D 11/00*** | (2006.01) |

(52) U.S. Cl.
CPC ..... *F04D 29/18* (2013.01); *F04D 11/00* (2013.01); *F04D 29/44* (2013.01)

(58) Field of Classification Search
CPC ..... F04D 29/18; F04D 29/44; F04D 11/00; F04D 29/4213; F04D 5/007; F04D 29/701
See application file for complete search history.

(56) References Cited

U.S. PATENT DOCUMENTS

| | | | | |
|---|---|---|---|---|
| 3,845,918 | A | 11/1974 | White, Jr. | |
| 10,865,799 | B2 * | 12/2020 | Yamashita | F04D 29/701 |
| 2015/0345515 | A1 * | 12/2015 | Isogai | F04D 29/4206 415/115 |

FOREIGN PATENT DOCUMENTS

| | | | |
|---|---|---|---|
| CN | 103452910 | A | 12/2013 |
| CN | 208024638 | U | 10/2018 |

(Continued)

*Primary Examiner* — Brian O Peters
(74) *Attorney, Agent, or Firm* — Bayramoglu Law Offices LLC

(57) ABSTRACT

An impeller wake vortex dissipation device under stall condition of a mixed flow pump includes a guide vane and a wake vortex dissipation device. The pump is evenly divided into n guide vane channels by N evenly distributed guide vanes. A wake vortex dissipation device is set in each guide vane channel, and one end of the wake vortex dissipation device is fixedly connected to the inner wall of the pump body. Therefore, each wake vortex dissipation device is located in the middle and upper part of the guide vane channel and does not occupy the lower guide vane channel; the wake vortex dissipation device is provided with a dissipative hole pair, which are used to dissipate the energy of the wake vortex of the impeller.

17 Claims, 5 Drawing Sheets

(56) References Cited

FOREIGN PATENT DOCUMENTS

| | | | |
|---|---|---|---|
| CN | 109882444 | A | 6/2019 |
| JP | 2006046168 | A | 2/2006 |

* cited by examiner

IMPELLER WAKE VORTEX DISSIPATION DEVICE UNDER STALL CONDITION OF MIXED FLOW PUMP

CROSS REFERENCE TO THE RELATED APPLICATIONS

This application is the national stage entry of International Application No PCT/CN2021/106645, filed on Jul. 16, 2021, which is based upon and claims priority to Chinese Patent Application No. 202110428441.1 filed on Apr. 21, 2021, the entire contents of which are incorporated herein by reference.

TECHNICAL FIELD

The present invention belongs to the technical field of internal flow of fluid machinery (pump), and in particular relates to an impeller wake vortex dissipation device under stall condition of mixed flow pump.

BACKGROUND

Mixed flow pump is a type of pump whose specific speed is between the centrifugal pump and axial flow pump. It has the characteristics of axial inflow and oblique outflow. With the wide application of mixed flow pump in sewage treatment, flood control and drainage, and farmland irrigation, the requirements for its performance are gradually improved. However, as the design theory of mixed flow pump is not perfect, there is no ability to design a mixed flow pump with the maximum efficiency under all flow rate conditions. In general, when the flow condition of mixed flow pump deviates from the design point, the pump efficiency will be reduced. Especially when the flow rate decreases, the efficiency of the mixed flow pump will decrease, but the head will increase. When the flow condition of the mixed flow pump is reduced to a certain range, the flow rate-head curve of the mixed flow pump will also decrease with the decrease of flow, that is, the phenomenon of "rotating stall" During this period, the unsteady flow of the flow field inside the mixed flow pump increases, and the unsteady characteristics are more obvious. The whole unit will have abnormal vibration and noise, which seriously threatens the safety of the operation. Many scholars have found that under stall condition, the vortex induced energy loss in the impeller and guide vane of mixed flow pump increases, which is the "culprit" of the sharp reduction of the pump head. In the impeller, it is mainly due to the influence of stall vortex and rim leakage vortex, while in the guide vane, it is due to the influence of impeller wake vortex and reflux vortex. Therefore, to improve the stability of the mixed flow pump under stall condition and reduce the influence of the above vortex structure on the flow field, it is necessary to develop a device or structure to eliminate or weaken the negative influence of many vortex structures in the mixed flow impeller and guide vane on the flow field After searching, the patent application No. CN201820156382.0 injects high-pressure water into the water injection hole inside the guide vane body, and then the high-pressure water flows along the jet hole on the suction surface of the guide vane into the flow channel between the guide vanes, and the jet between the guide vanes disperses the stall vortex. But this method is only suitable for pumps with thicker guide vanes, and it is to eliminate the stall vortex in the guide vane, the vortex structure generated by impeller wake can not be effectively improved.

After searching, there are no patent applications or literature on improving or eliminating wake vortices of mixed flow pump impellers install conditions.

SUMMARY

The present invention proposes an impeller wake vortex dissipation device under stall condition of mixed flow pump. By setting an impeller wake vortex dissipation device in the guide vane channel, the impeller wake vortex is dissipated in advance, to improve the flow field in the guide vane of the mixed flow pump.

The technical solution adopted by the present invention is as follows:

A wake vortex dissipation device of an impeller under stall condition of a mixed flow pump, which includes a guide vane and a wake vortex dissipation device; the inside of the pump is evenly divided into N guide vane channels by N evenly distributed guide vanes; a wake vortex dissipation device is set in each guide vane channel, and one end of the wake vortex dissipation device is fixedly connected to the inner wall of the pump body; each wake vortex dissipation device is located in the middle and upper part of the guide vane channel and does not occupy the lower guide vane channel; the wake vortex dissipation device is provided with a dissipative hole pair, which are used to dissipate the energy of the wake vortex of the impeller.

Further, the wake vortex dissipation device includes a fixed part and an action part; the action part is provided with a dissipative hole pair for dissipating the energy of the wake vortex of the impeller; the fixing part is vertically arranged along the chord long side of the action part, and the fixing part is fixedly connected with the outer shell of the pump by fasteners.

Further, between two adjacent guide vanes, the concave surface of the wake vortex dissipation device is opposite to the pressure surface of one guide vane, and the convex surface of the wake vortex dissipation device is opposite to the suction surface of the other guide vane.

Further, the distance $L_1$ between the concave surface and the pressure surface opposite to the concave surface and the distance $L_2$ between the convex surface and the suction surface opposite to the convex surface of the wake vortex dissipation device is less than 10% of a width of each guide vane channel.

Further, several rows of through hole groups are arranged on the action part of the wake vortex dissipation device along the radial direction; all through holes in the same row of through hole groups are set in the same direction, and the through holes in the two adjacent rows of through hole groups are set in the opposite direction at such intervals.

Further, the through holes close to each other in the two adjacent rows of through holes form a dissipative hole pair, and the central axes of the two through holes forming the dissipative hole pair intersect the convex surface of the wake vortex dissipation device; the included angle of the central axis is acute.

Further, the diameter of the through holes on the wake vortex dissipation device is the same.

Further, the spacing between two through holes in each dissipative hole pair shall not exceed 3 times the through hole diameter, and the spacing between adjacent dissipative hole pairs shall not be greater than the through hole diameter.

Further, the action part of the wake vortex dissipation device is equally thick along the mainstream direction, and the thickness is not less than 5 mm.

Further, during installation, the inlet edge of the wake vortex dissipation device is flush with the inlet edge of the guide vane, or the axial plane projection of the inlet edge of the wake vortex dissipation device falls within the range from the inlet edge of the guide vane to 20% of the chord length of the guide vane The beneficial effects of the present invention are as follows:

An impeller wake vortex dissipation device under stall condition of a mixed flow pump. Setting an impeller wake vortex dissipation device in the guide vane channel, pairs of through holes are processed on the wake vortex dissipation device to form pairs of dissipation holes; the dissipation hole is used to dissipate the energy of the impeller wake vortex in advance, to avoid its influence on the flow field in the guide vane, improving the flow field structure in the guide vane of the mixed flow pump under stall condition and the efficiency of the mixed flow pump under the condition of deviating from the designed flow rate, expanding the working range of the mixed flow pump.

In the figures: 1. guide vane hub, 2. guide vane, 3. wake vortex dissipation device, 4. threaded hole, 5. A through hole, 6. B through hole, 7. dissipation hole pair, 8. impeller, 9. C through hole, 10. boss, 11 shell body.

DETAILED DESCRIPTION OF THE EMBODIMENTS

To make the object, technical solutions and advantages of the present invention more clearly understood, the present invention is described in further detail in the future in conjunction with the accompanying drawings and embodiments. It should be understood that the specific embodiments described herein are intended to explain the present invention only and are not intended to limit it.

Figure 5:
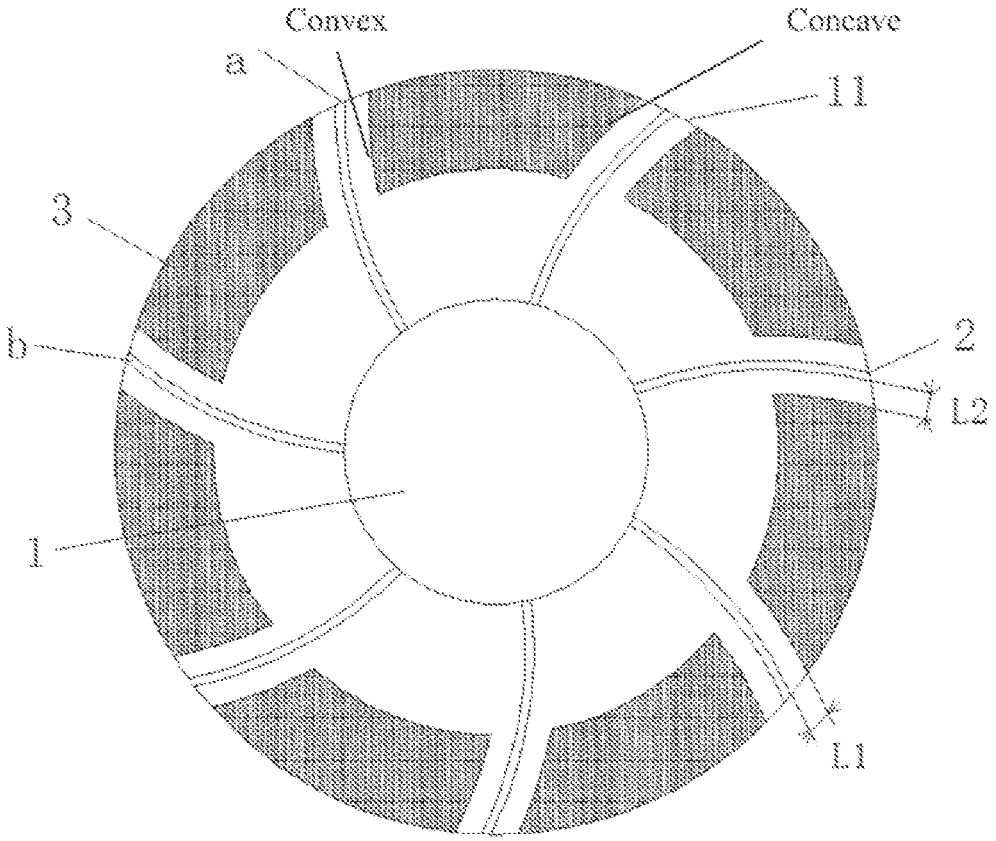
FIG. 5 is an axial view of the impeller wake vortex dissipation device under stall condition of the mixed flow pump of the present invention.

An impeller wake vortex dissipation device under stall condition of a mixed flow pump includes a guide vane 2, a wake vortex dissipation device 3 and a shell body 11. N guide vanes 2 are evenly distributed on the guide vane hub 1; guide vanes 2 evenly divide the inside of the pump into n flow channels. A wake vortex dissipation device 3 is arranged in each channel divided by the guide vane 2, as shown in FIG. 5. The wake vortex dissipation device 3 is fixedly installed inside housing 11. The wake vortex dissipation device 3 is located in the middle and upper part of the flow channel and does not occupy the lower flow channel. The radial height of the wake vortex dissipation device 3 does not exceed ½ of the height of the guide vane 2.

Figure 2:
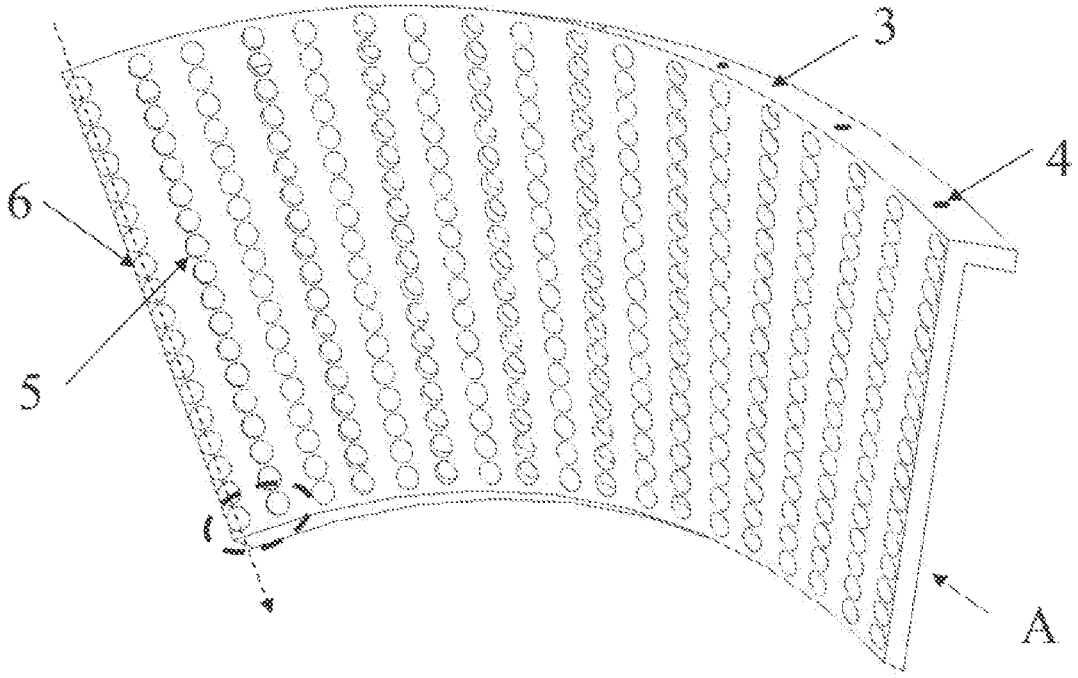
FIG. 2 shows a schematic diagram of the structure of the impeller wake vortex dissipation device of the present invention.

More specifically, the structure of the wake vortex dissipation device 3 is shown in FIG. 2, and the wake vortex dissipation device 3 includes a fixing part and an action part. The action part is used to dissipate the energy of the wake vortex of the impeller; the fixing part is vertically arranged along the chord length side of the action part, and the fixing part is used to fixedly install the wake vortex dissipation device 3 in the pump cavity.

Figure 1:
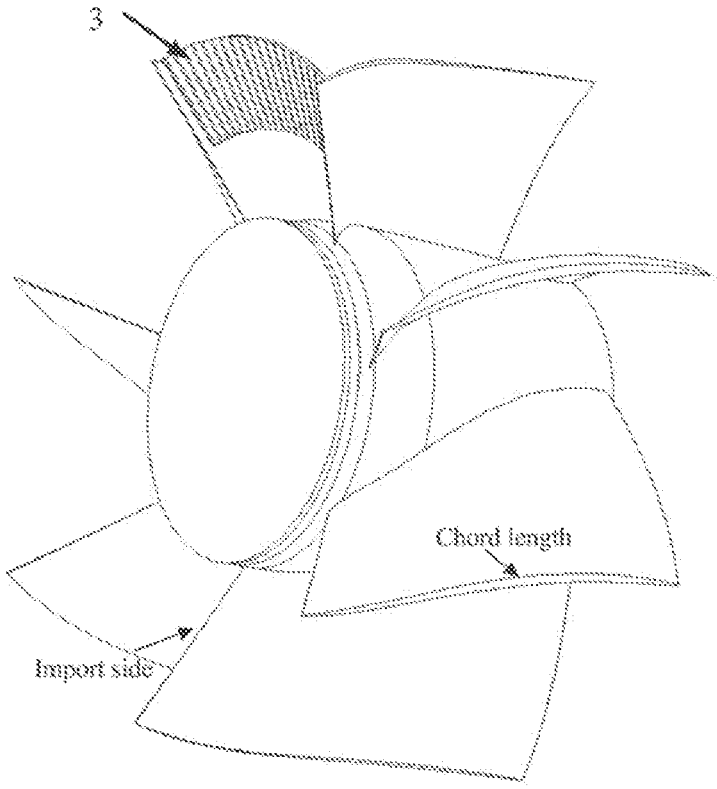
FIG. 1 shows a schematic diagram of the impeller wake vortex dissipation device under stall condition of the mixed flow pump of the present invention.
Figure 4:
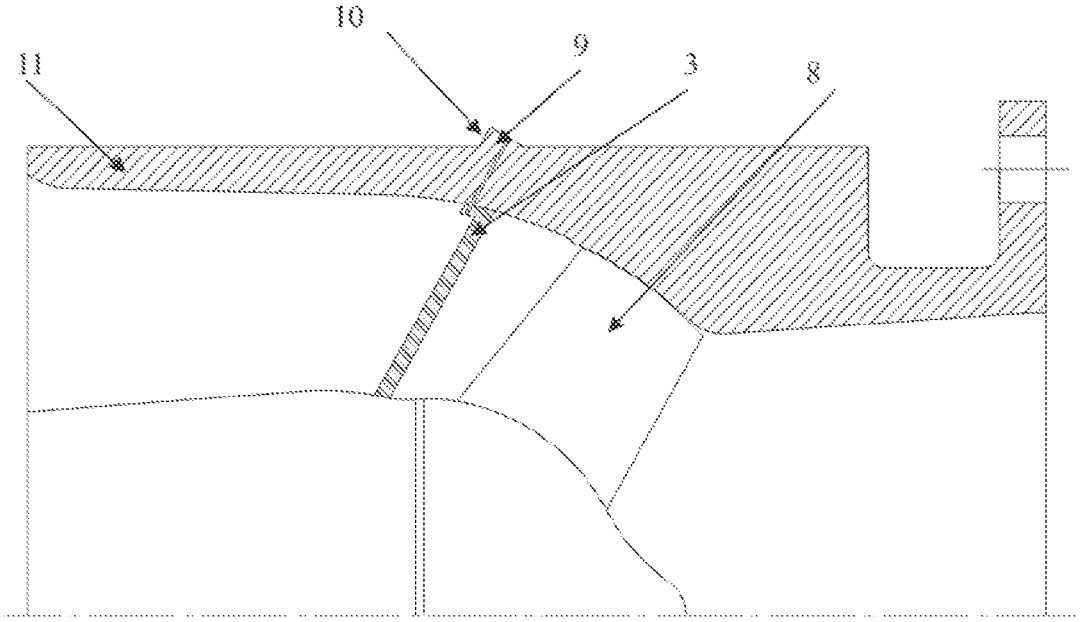
FIG. 4 shows the assembly diagram of the impeller wake vortex dissipation device of the present invention.

As shown in FIGS. 1 and 4, the action part of the wake vortex dissipation device 3 is equally thick along the mainstream direction, and the thickness is not less than 5 mm. Between two adjacent guide vanes (such as blade a and blade b in FIG. 5), the concave surface of the wake vortex dissipation device is opposite to the pressure surface of one guide vane (blade a), and the convex surface of the wake vortex dissipation device is opposite to the suction surface of the other guide vane (blade b). The concave surface of the wake vortex dissipation device 3 is opposite to the pressure surface of the guide vane 2, and the convex surface of the wake vortex dissipation device 3 is opposite to the suction surface of the guide vane 2. And the distance L1 between the concave surface and the pressure surface opposite to the concave surface and the distance L2 between the convex surface and the suction surface opposite to the convex surface is less than 10% of the channel width.

Figure 3:
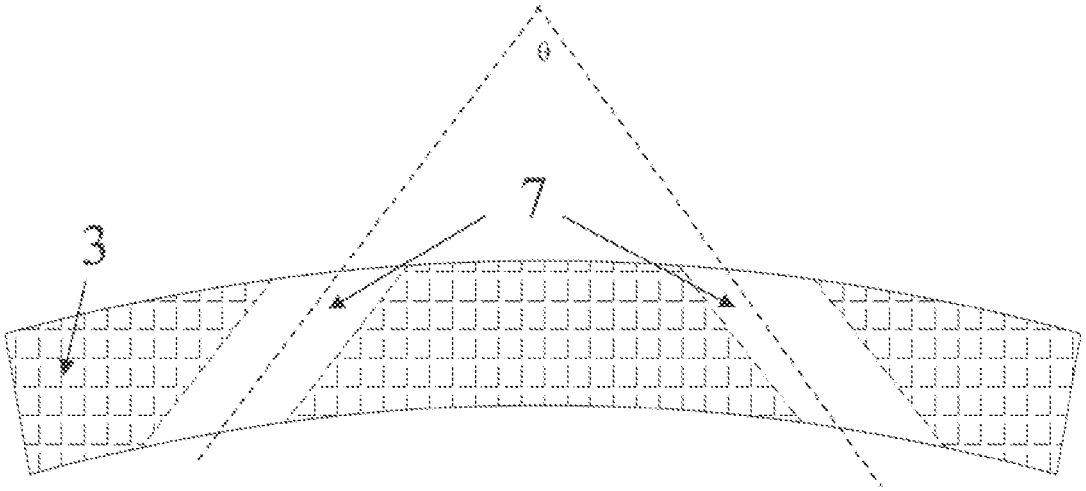
FIG. 3 shows an A-direction sectional view of the impeller wake vortex dissipation device of the present invention.

As shown in FIG. 2, several rows of through hole groups are arranged on the action part of the wake vortex dissipation device 3 along the radial direction (dotted arrow in FIG. 2); all through holes in the same row of through hole groups are set in the same direction, and the through holes in the two adjacent rows of through hole groups are set in the opposite direction at such intervals. As shown in FIG. 3, in the first row of through hole group on the far left is B-through hole 6, and in the adjacent row of through hole group on the right is A-through hole 5; A through hole 5 and B through hole 6 close to each other in the two adjacent rows of through hole groups form a dissipative hole pair 7. In each dissipative hole pair 7, the central axis of the a-through hole 5 and the central axis of the b-through hole 6 intersect on the convex surface of the wake vortex dissipation device 3 to form an included angle θ, and included angle θ is an acute angle. Due to the existence of dissipative hole pair 7, the fluid interacts after passing through dissipative hole pair 7, which can realize part of the energy consumption. Although the directions of a-through hole 5 and b-through hole 6 are different, the diameters of a-through hole 5 and b-through hole 6 are the same. The distance L between the a-through hole 5 and the b-through hole 6 in each dissipative hole pair 7 on the concave surface does not exceed 3 times the diameter of the through hole a 5 (or the through hole B 6). The spacing between adjacent dissipative hole pairs 7 is not greater than the diameter of through hole a 5 (or through hole B 6). The dissipative hole pair 7 is also evenly distributed along the circumferential direction, and the spacing between each dissipative hole pair 7 with the shortest distance from the guide vane centerline, that is, the dissipative hole pair 7 at the bottom of the wake vortex dissipative device 3 (the dissipative hole pair 7 at the position shown in the dotted line box in FIG. 2) shall not be greater than the diameter of the through hole a 5 or through hole B 6, to ensure that the a-through hole 5 and b-through hole 6 in the lowest dissipative hole pair 7 can't coincide. The profile of the circumferential projection of the action part is a straight line or curve.

The fixed part of the wake vortex dissipation device 3 is equally thick along the mainstream direction, but the thickness of the fixed part is greater than that of the action part. The fixed part of the wake vortex dissipation device 7 is provided with a threaded hole 4 along the circumferential direction, and a through hole C9 is arranged at the position corresponding to the fixed part of the housing 11. At the same time, a boss 10 is processed on the outside of the through hole of the housing body 11 to fix the fixing part and the housing body 11 by bolts.

As for the installation position of the wake vortex dissipation device 3, the inlet edge of the wake vortex dissipation device 3 is flush with the inlet edge of the guide vane 2, or the axial plane projection of the inlet edge of the wake vortex dissipation device 3 falls within the chord length range of 20% of the guide vane 2 from the inlet edge of the guide vane 2. After the wake vortex dissipation device 3 is installed in each guide vane, it is necessary to ensure that the axial projection of each wake vortex dissipation device 3 coincides with each other.

The above examples are only used to illustrate the design ideas and features of the present invention, and its purpose is to enable a person skilled in the art to understand the content of the present invention and implement it accordingly. Therefore, any equivalent changes or modifications based on the principles and design ideas revealed by the present invention are within the scope of protection.

What is claimed is:

1. An impeller wake vortex dissipation device under stall condition of a mixed flow pump, comprising a guide vane and a wake vortex dissipation device, wherein an inside of the mixed flow pump is evenly divided into N guide vane channels by N evenly distributed guide vanes; the wake vortex dissipation device is set in each guide vane channel, and one end of the wake vortex dissipation device is fixedly connected to the inner wall of the pump body, so each wake vortex dissipation device is located in a middle and upper part of each guide vane channel and does not occupy a lower guide vane channel; and the wake vortex dissipation device is provided with a dissipative hole pair, which is used to dissipate energy of an impeller wake vortex.

2. The device according to claim 1, wherein the wake vortex dissipation device comprises a fixing part and an action part; the dissipative hole pair is arranged at the action part for dissipating the energy of the impeller wake vortex; the fixing part is vertically arranged along a chord long side of the action part, and the fixing part is fixedly connected with a housing body of the mixed flow pump by fasteners.

3. The device according to claim 1, wherein between two adjacent guide vanes, a concave surface of the wake vortex dissipation device is opposite to a pressure surface of one of the two adjacent guide vanes, and a convex surface of the wake vortex dissipation device is opposite to a suction surface of another of the two adjacent guide vanes.

4. The device according to claim 3, wherein a distance L1 between the concave surface and the pressure surface opposite to the concave surface and a distance L2 between the convex surface and the suction surface opposite to the convex surface of the wake vortex dissipation device are less than 10% of a width of each guide vane channel.

5. The device according to claim 4, wherein several rows of through hole groups are arranged on the action part of the wake vortex dissipation device along a radial direction; all through holes in a same row of through hole groups are set in a same direction, and the through holes in two adjacent rows of through hole groups are set in the opposite direction at such intervals.

6. The device according to claim 5, wherein the through holes close to each other in the two adjacent rows of through hole groups form a dissipative hole pair, and central axes of the two through holes form the dissipative hole pair intersect the convex surface of the wake vortex dissipation device, and an included angle of the central axes is an acute angle.

7. The device according to claim 5, wherein diameters of the through holes on the wake vortex dissipation device are the same.

8. The device according to claim 5, wherein a spacing between two through holes in each dissipative hole pair is not exceed 3 times the through hole diameter, and the spacing between adjacent dissipative hole pairs shall not be greater than the through hole diameter.

9. The device according to claim 1, wherein the action part of the wake vortex dissipation device is equally thick along a mainstream direction, and a thickness is not less than 5 mm.

10. The device according to claim 9, wherein during installation, an inlet edge of the wake vortex dissipation device is flush with an inlet edge of the guide vane, or an axial plane projection of the inlet edge of the wake vortex dissipation device falls within a chord length range from the inlet edge of the guide vane to 20% of the guide vane.

11. The device according to claim 2, wherein the action part of the wake vortex dissipation device is equally thick along a mainstream direction, and a thickness is not less than 5 mm.

12. The device according to claim 3, wherein the action part of the wake vortex dissipation device is equally thick along a mainstream direction, and a thickness is not less than 5 mm.

13. The device according to claim 4, wherein the action part of the wake vortex dissipation device is equally thick along a mainstream direction, and a thickness is not less than 5 mm.

14. The device according to claim 5, wherein the action part of the wake vortex dissipation device is equally thick along a mainstream direction, and a thickness is not less than 5 mm.

15. The device according to claim 6, wherein the action part of the wake vortex dissipation device is equally thick along a mainstream direction, and a thickness is not less than 5 mm.

16. The device according to claim 7, wherein the action part of the wake vortex dissipation device is equally thick along a mainstream direction, and a thickness is not less than 5 mm.

17. The device according to claim 8, wherein the action part of the wake vortex dissipation device is equally thick along a mainstream direction, and a thickness is not less than 5 mm.

* * * * *